US009991023B2

(12) United States Patent
Buck et al.

(10) Patent No.: US 9,991,023 B2
(45) Date of Patent: Jun. 5, 2018

(54) INTERCONNECT CABLE HAVING INSULATED WIRES WITH A CONDUCTIVE COATING

(71) Applicant: Tyco Electronics Corporation, Berwyn, PA (US)

(72) Inventors: Arthur G. Buck, Sherwood, OR (US); Yevgeniy Mayevskiy, Lake Oswego, OR (US); Malai H. Khamphilavong, Woodburn, OR (US); Thuong A. Huynh, Beaverton, OR (US)

(73) Assignee: CREGANNA UNLIMITED COMPANY, Galway (IE)

( * ) Notice: Subject to any disclaimer, the term of this patent is extended or adjusted under 35 U.S.C. 154(b) by 0 days. days.

(21) Appl. No.: 13/753,339

(22) Filed: Jan. 29, 2013

(65) Prior Publication Data

US 2014/0209346 A1 Jul. 31, 2014

(51) Int. Cl.

| | |
|---|---|
| ***H01B 7/00*** | (2006.01) |
| ***H01B 19/00*** | (2006.01) |
| ***H01B 7/04*** | (2006.01) |
| ***H01B 7/08*** | (2006.01) |

(52) U.S. Cl.

CPC ..... *H01B 7/0045* (2013.01); *H01B 7/041* (2013.01); *H01B 7/0892* (2013.01); *H01B 19/00* (2013.01); *Y10T 29/49117* (2015.01)

(58) Field of Classification Search

CPC ... H01B 1/00; H01B 1/02; H01B 1/14; H01B 1/20; H01B 3/10; H01B 5/00; H01B 5/14; H01B 7/00; H01B 7/0009; H01B 11/00; H01B 11/06; H01B 11/10–11/091; H01B 11/18; H01B 11/1877; H01B 11/1878; H01R 9/00; H01R 9/03; H01R 9/032; H01R 9/034; H01R 9/037; H01R 9/05; H01R 9/0503

USPC ..... 174/36, 102 R, 110 R, 113 R, 117 R, 174/117 F, 125.1, 126.1, 126.2

See application file for complete search history.

(56) References Cited

U.S. PATENT DOCUMENTS

| | | | | |
|---|---|---|---|---|
| 2,933,457 A * | 4/1960 | Steinberg | 252/511 | |
| 3,126,358 A * | 3/1964 | Lemmerich | 524/462 | |
| 3,512,946 A * | 5/1970 | Hutkin | 428/612 | |
| 3,639,674 A * | 2/1972 | Stier | H01B 9/02 174/102 R | |

(Continued)

FOREIGN PATENT DOCUMENTS

| | | |
|---|---|---|
| CN | 1352799 A | 6/2002 |
| CN | 1695208 A | 11/2005 |

(Continued)

OTHER PUBLICATIONS

International Search Report for International Application No. PCT/US2014/013673, mailed Mar. 14, 2014.

(Continued)

*Primary Examiner* — William H Mayo, III

(57) ABSTRACT

A cable assembly includes a plurality of wires. Each wire has a first end, intermediate section, and a second end. The intermediate sections of the respective wires are detached from each other. A conductive shield surrounds the respective intermediate sections of the plurality of wires. Each wire includes a conductor, an insulating layer that surrounds the conductor, and a conductive coating formed on an outside surface of the insulating layer.

17 Claims, 3 Drawing Sheets

(56) References Cited

U.S. PATENT DOCUMENTS

| | | | | |
|---|---|---|---|---|
| 3,644,662 | A * | 2/1972 | Salahshourian | 174/73.1 |
| 3,870,977 | A | 3/1975 | Peoples et al. | |
| 3,927,247 | A | 12/1975 | Timmons | |
| 4,374,299 | A | 2/1983 | Kincaid | |
| 4,424,403 | A * | 1/1984 | Bogese, II | 174/36 |
| 4,599,121 | A | 7/1986 | Edwards et al. | |
| 4,606,074 | A | 8/1986 | Rodeffer | |
| 4,691,081 | A | 9/1987 | Gupta et al. | |
| 4,965,412 | A | 10/1990 | Lai et al. | |
| 4,986,372 | A | 1/1991 | Ganssle | |
| 5,523,534 | A | 6/1996 | Meister et al. | |
| 5,665,940 | A * | 9/1997 | Chimura et al. | 174/116 |
| 5,827,997 | A * | 10/1998 | Chung et al. | 174/388 |
| 6,472,603 | B1 * | 10/2002 | Inoue | 174/121 R |
| 6,580,034 | B2 * | 6/2003 | Daane et al. | 174/117 F |
| 6,651,318 | B2 | 11/2003 | Buck et al. | |
| 6,734,362 | B2 * | 5/2004 | Buck et al. | 174/113 R |
| 7,271,340 | B2 | 9/2007 | Buck et al. | |
| 7,471,258 | B2 | 12/2008 | Hsu | |
| 7,491,883 | B2 * | 2/2009 | Lee et al. | 174/28 |
| 8,013,252 | B2 | 9/2011 | Daane et al. | |
| 2002/0139561 | A1 | 10/2002 | Buck et al. | |
| 2004/0194996 | A1 * | 10/2004 | Ysbrand | 174/102 SC |
| 2004/0200634 | A1 * | 10/2004 | Ysbrand | 174/102 R |
| 2005/0011664 | A1 | 1/2005 | Lee | |
| 2005/0106522 | A1 * | 5/2005 | Eroglu et al. | 431/350 |
| 2010/0000754 | A1 * | 1/2010 | Mann | H01B 1/04 174/34 |
| 2010/0096597 | A1 * | 4/2010 | Prud'Homme | B82Y 30/00 252/511 |
| 2010/0144904 | A1 * | 6/2010 | Wang | B82Y 30/00 516/98 |
| 2011/0079410 | A1 | 4/2011 | Eshima | |
| 2011/0232937 | A1 | 9/2011 | Montena et al. | |
| 2012/0043107 | A1 * | 2/2012 | Nair | H01B 7/0876 174/103 |
| 2013/0025907 | A1 * | 1/2013 | Zheng | H01B 1/04 174/105 R |
| 2013/0048337 | A1 * | 2/2013 | Hemond | D06M 13/50 174/113 C |
| 2013/0068521 | A1 * | 3/2013 | Hong | H05K 9/0081 174/388 |
| 2013/0217249 | A1 * | 8/2013 | Patel | H01R 13/516 439/188 |
| 2014/0014392 | A1 | 1/2014 | Armbrecht et al. | |

FOREIGN PATENT DOCUMENTS

| | | | | |
|---|---|---|---|---|
| CN | 1889196 | A | 1/2007 | |
| CN | 2881897 | Y | 3/2007 | |
| CN | 201233756 | Y | 5/2009 | |
| CN | 102034567 | A | 4/2011 | |
| CN | 102782776 | A | 11/2012 | |
| CN | 202694973 | U | 1/2013 | |
| DE | 202011005272 | U1 | 2/2012 | |
| GB | 1106010 | A * | 8/1965 | H01B 3/00 |
| WO | WO-94/02948 | A1 | 2/1994 | |

OTHER PUBLICATIONS

International Search Report for International Application No. PCT/US2014/013672, mailed Mar. 14, 2014.

Search Report from First Office Action for Chinese Patent Application No. 201480006337.1, dated Mar. 21, 2016.

* cited by examiner

INTERCONNECT CABLE HAVING INSULATED WIRES WITH A CONDUCTIVE COATING

DESCRIPTION OF RELATED ART

Field

This application relates to a cable with multiple insulated wires. In particular, this application relates to an interconnect cable having insulated wires with a conductive coating.

Background

Many medical devices include a base unit and a remote unit where the remote unit communicates information to and from the base unit. The base unit then processes information communicated from the remote unit and provides diagnostic information, reports, and the like. In some arrangements, a cable that includes a group of electrical wires couples the remote unit to the base unit. The size of the cable typically depends on the number of conductors running through the cable and the gauge or thickness of the conductors. The number of conductors running within the cable tends to be selected according to the amount of information communicated from the remote unit to the base unit. That is, the higher the amount of information, the greater the number of conductors.

In more advanced medical devices that use the base/remote unit arrangement, a great deal of information may be communicated between the remote component and the base unit. For example, a transducer of an ultrasound machine may communicate analog information over hundreds of conductors to an ultrasound image processor. Electrical cross-talk between adjacent conductors can become an issue. One way to reduce cross-talk is to increase the thickness of the insulating material that surrounds respective conductors. In some cases, a braided shield wire may be wrapped around the insulating material to further improve the cross-talk characteristics. However, increased thickness of the insulating material and the addition of a braided shield wire result in a decrease in the number of conductors that may pass through a cable of a given thickness. To alleviate this problem, higher gauge (i.e., thinner) conductors may be utilized. However, the thinner conductors tend to be more fragile, thus limiting the useful life of the cable.

BRIEF SUMMARY

An object of the application is to provide a cable assembly that includes a plurality of wires. Each wire has a first end, an intermediate section, and a second end. The intermediate sections of the respective wires are detached from each other. A conductive shield surrounds the respective intermediate sections of the plurality of wires. In alternate embodiments, a non-conductive shield may surround the plurality of wires in the intermediate section. In yet other embodiments, no shield is provided. Each wire includes a conductor, an insulating layer that surrounds the conductor, and a conductive coating formed on an outside surface of the insulating layer.

Another object of the application is to provide a method for manufacturing a cable assembly. The method includes providing a group of conductors, and forming an insulating layer around each conductor to thereby form separate insulated wires. A conductive coating is formed on an outside surface of the insulating layer of each wire. A braided shield is applied over the plurality of wires and a sheath is formed over the braided shield.

Other features and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

The embodiments described below overcome the problems with existing base/remote unit systems by providing a cable that includes insulated wires that have a conductive coating formed on an outside surface of the insulation. The conductive coating generally decreases the mutual capacitance between adjacent wires and lessens the effects of electromagnetic interference on signals propagated over the wires. The conductive coating facilitates the use of an insulator with a smaller diameter than known wires, and thus facilitates an increase in the number of wires that may be positioned within a cable of a given diameter.

Figure 1:
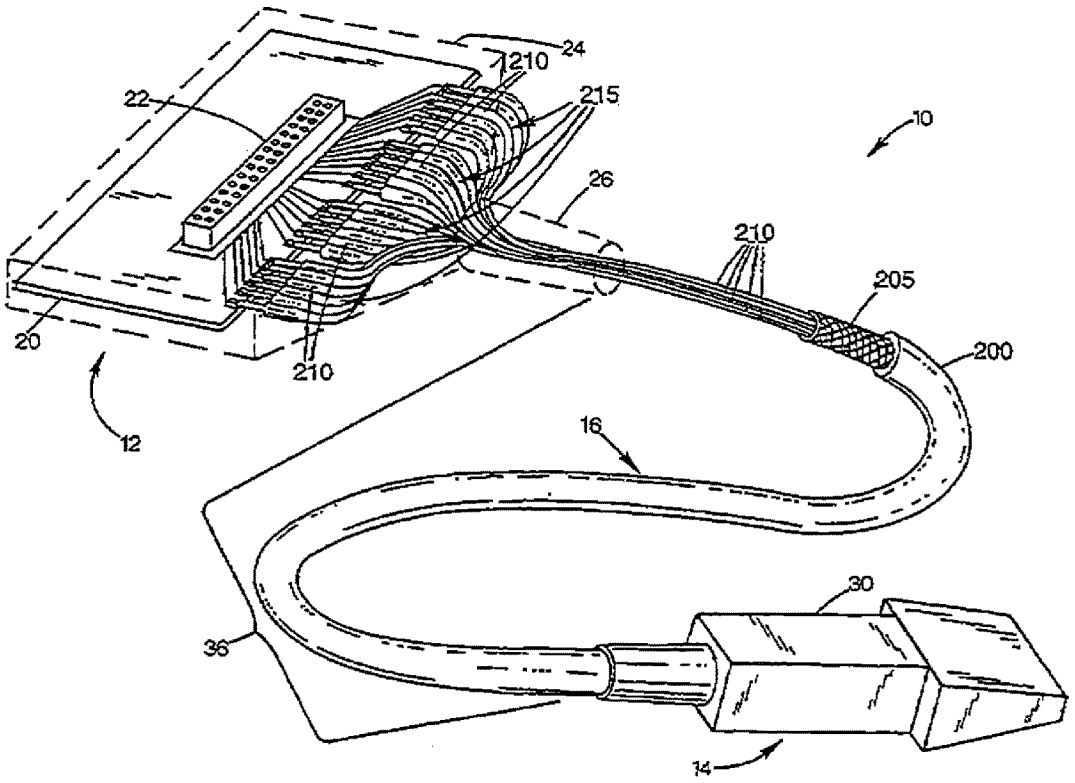
FIG. 1 is a perspective view of a cable assembly according to an embodiment.

FIG. 1 illustrates an exemplary cable assembly 10. The cable assembly 10 includes a connector end 12, a transducer end 14, and a connecting flexible cable 16. In this exemplary cable assembly 10, the connector end 12 includes a circuit board 20 with a header connector 22 configured to couple to an electronic instrument such as an ultrasound imaging machine. The connector end 12 includes a connector housing 24, and strain relief 26 that surrounds the end of the cable 16. An ultrasound transducer 30 may, for example, be connected to the opposite end of the cable 16. It is understood that the connector end 12 and transducer end 14 are merely exemplary. Other components may connect to the cable 16.

Figure 2A:
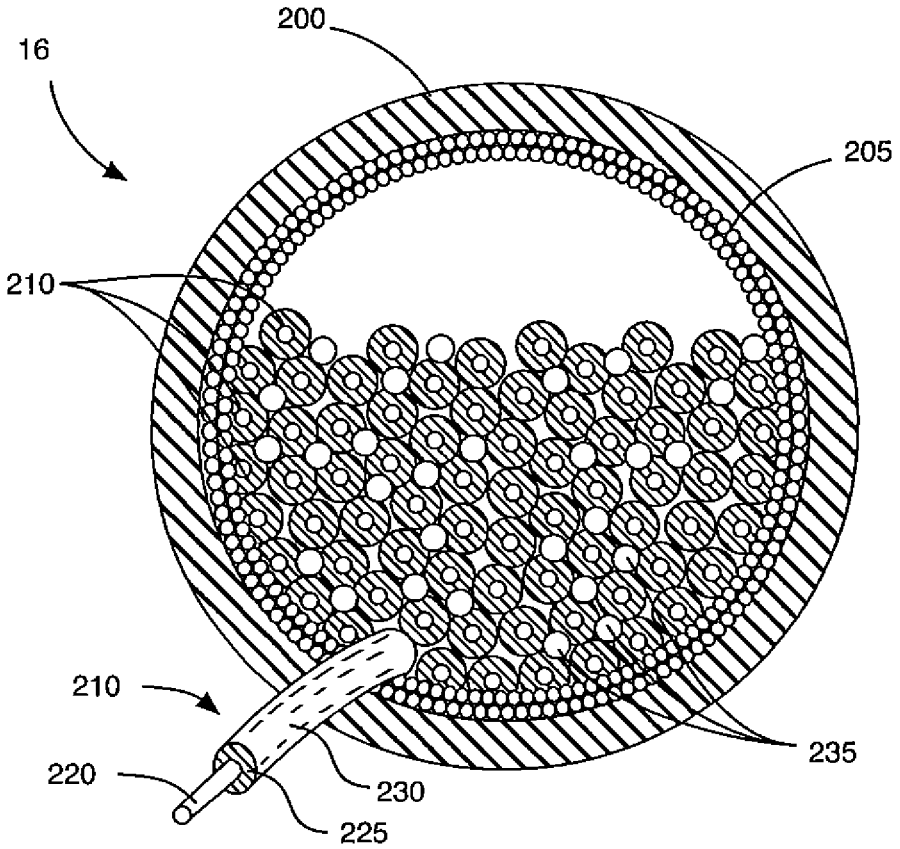
FIG. 2A is a cross-sectional view of an exemplary cable that may be utilized in the cable assembly of FIG. 1.

FIG. 2A illustrates an exemplary cross-section of the cable 16. The cable 16 includes a sheath 200, a braided shield 205, a group of insulated wires 210, and a group of non-insulated wires 235. It should be understood that the number of insulated wires 210 and non-insulated wires 235 is merely exemplary and not necessarily representative of any number of wires that may actually be required in any particular application.

The sheath 200 defines the exterior of the cable 16. The sheath 200 may be formed from any non-conductive flexible material, such as polyvinyl chloride (PVC), polyethylene, or polyurethane. The sheath 200 may have an exterior diameter of about 8.4 mm (0.33 inch). The bore diameter, which is measured at the inner diameter of the braided shield 205, if present, may be 6.9 mm (0.270 inch). This yields a bore cross-section (when straight, in the circular shape) of 1.4 $mm^2$ (0.057 $inch^2$). This size sheath 200 facilitates the placement of about 64 to 256 wires 210. The diameter of the sheath 200 may be increased or decreased accordingly to accommodate a different number of insulated and non-insulated wires 210 and 235.

The braided shield 205 is provided on the interior surface of the sheath 200 and surrounds all the wires 210 and 235. The braided shield 205 may be a conductive material, such as copper, or a different material suited for shielding the non-insulated wires 235 from external sources of electromagnetic interference. In some implementations, the braided shield 205 may be silver-plated and may form a mesh-like structure that surrounds insulated wires 210.

Figure 2B:
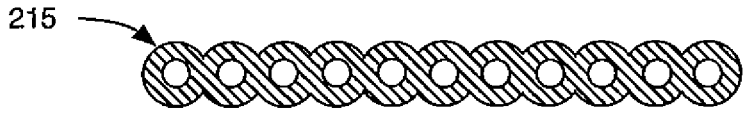
FIG. 2B is an exemplary ribbonized end section of the cable of FIG. 2A.

The insulated wires 210 may be arranged into sub-groups, with each sub-group having a "ribbonized" ribbon portion 215 (FIG. 2B) at each end of the cable 16. That is, insulated wires 210 of the sub-group may be attached or adhered to each other in a side-by-side manner to form a ribbon. Each ribbon portion 215 may be trimmed to expose a center conductor 220 of each insulated wire 210 to facilitate connecting of the insulated wire 210 to the circuit board 20 or to any electronic component or connector by any conventional means, as dictated by the needs of the application for which the cable 16 is used. The ribbon portions 215 may be marked with unique indicia to enable assemblers to correlate ribbon portions 215 at opposite ends of the cable 16.

In a middle section 36 (FIG. 1) of the cable 16, insulated wires 210 of the sub-group are generally loose and free to move independently of one another within the braided shield 205 and sheath 200. The independence of the wires improves flexibility of the cable 16 and lowers the level of cross-talk that occurs between adjacent insulated wires 210, as described in U.S. Pat. No. 6,734,362 B2, issued May 11, 2004, which is incorporated herein by reference. The loose portions 36 of the insulated wires 210 extend the entire length of the cable 16 between the strain reliefs, through the strain reliefs, and into the housing where the ribbon portions 215 are laid out and connected.

Each insulated wire 210 includes a center conductor 220 that is surrounded by an insulating material 225, such as a fluoropolymer, polyvinyl chloride, or polyolefin, e.g. polyethylene. The conductor 220 may be copper or plated copper (e.g. silver-plated copper, tin-plated copper, or gold-plated copper) or a different conductive material. The conductor 220 may be solid or stranded and may have a gauge size of about 52 AWG (0.020 mm (0.00078 inch) diameter) to 36 AWG (0.13 mm (0.005 inch) diameter (solid wire), 0.15 mm (0.006 inch) diameter (stranded wire) The conductor 220 material and gauge may be selected to facilitate a desired current flow though a given conductor 220. For example, the gauge of the conductor 220 may be decreased (i.e., increased in diameter) to facilitate increased current flow. Stranded as opposed to solid wire may be utilized to improve overall flexibility of the cable 16. The insulated wires 210 may all have the same characteristics or may be different. That is, the insulated wires 210 may have different gauges, different conductors, etc.

The insulating material 225 that surrounds the conductor 220 may be made of a material such as fluoropolymer, or polyolefin, e.g. polyethylene, or a material such as polyvinyl chloride. The thickness of the insulating material 225 may be about 0.05 to 0.64 mm (0.002 to 0.025 inch). Increased thickness of the insulating material 225 improves the cross-talk characteristic (i.e., decreases the mutual capacitance between wires) and, therefore, lowers the cross-talk between adjacent insulated wires 210. On the other hand, the increase in thickness lowers the total number of insulated wires 210 that may be positioned within the braided shield 205. The thickness of insulating material may be used to control capacitance and characteristic impedance.

A conductive coating 230 is formed on the outside surface of the insulating material 225. The conductive coating 230 may be any appropriate material such as carbon, graphite, graphene, silver, or copper, and may be in a suspended solution. It may be applied via a spraying or dispersion process or other processes suited for applying a thin layer of conductive material. In one implementation, a colloidal dispersion of graphite in isopropyl alcohol or carbon/graphite particles in a fluoropolymer binder suspended in methylethylketone, may be used. For example, Dag 502 (also known as Electrodag 502) may be used. In another implementation, a product such as Vor-ink Gravure™ from Vorbeck Materials, which contains graphene, may be applied via dispersion coating to a thickness about 0.005 mm (0.0002 inch). Application of the conductive coating 230 further lowers the mutual capacitance between adjacent insulated wires 210 and, therefore, further lowers the cross-talk. At the same time, the self-capacitance of the wire will increase; therefore, the characteristic impedance of the wires may be controlled by varying the thickness and the conductivity of coating materials. The thickness is generally less than about 0.010 mm (0.0004 inch), preferably about 0.005 mm (0.0002 inch) or less. In one implementation, insulated wires 210 of about 0.91 m (3 feet) in length with the conductive coating 230 of graphene dispersed in isopropyl alcohol were found to have a mutual capacitance of less than about 2 pF. The corresponding cross-talk between adjacent insulated wires 210 was found to be lower than about −34 dB below 5 MHz and lower than about −31 dB between 5 MHz and 10 MHz, compared to lower than −26 dB below 5 MHz, and lower than −23 dB for regular uncoated design. The addition of the conductive coating 230, therefore, facilitates a decrease in the thickness of the wire 210 compared to the standard coaxial cable of the same gauge and self capacitance. Thus, the conductive coating 230 facilitates an increase in the number of wires 210 that may be positioned within a sheath 200 of a given diameter compared to the coaxial design. It should be understood that the characteristics described above, as well as the characteristic impedance of the insulated wires 210, may be adjusted by selecting conductive coatings 230 that have different conductivities, changing the thickness of the insulating material 225 or selecting an insulating material 225 with a given dielectric constant, etc.

In some implementations, at least one non-insulated wire 235 is positioned within the sheath 200 and the braided shield 205, and may contact the conductive coating 230 of one or more insulated wires 210. The non-insulated wire 235 may be a conductive material, such as copper. The non-insulated wire 235 may have a gauge of about 48 AWG (a diameter of 0.031 mm (0.00124 in) for solid wires and 0.038 mm (0.0015 in) for stranded wires), although other gauges are contemplated. For example, in alternative embodiments, wires of 38 AWG (a diameter of 0.12 mm (0.0048 in) for stranded wires and 0.10 mm (0.004 in) for solid wires) to 42 AWG (a diameter of 0.076 mm (0.003 in) for stranded wires and 0.063 mm (0.0025 in) for stranded wires) may be utilized. At respective ends of the cable 16, the non-insulated wire 235 may be terminated to ground. Grounding of the non-insulated wire 235 in turn grounds the conductive coating 230 of the insulated wires 210 by virtue of the contact between the non-insulated wire 235 and the conductive coatings 230 of respective insulated wires 210. It can be shown that most, if not all, of the insulated wires 210 within the cable 16 will be in contact with another at some location within the cable 16. Therefore, grounding of the non-insulated wire 235 effectively grounds the conductive coating 230 of all the insulated wires 210. The ground of the conductive coating 230 in turn reduces the effects of external sources of electromagnetic interference on the signals propagated via the insulated wires 210. In some implementations, the ratio of coated insulated wires 230 can be 4:1 or greater to improve the grounding characteristics of the conductive coating 230 of the respective insulated wires 210.

Figure 3:
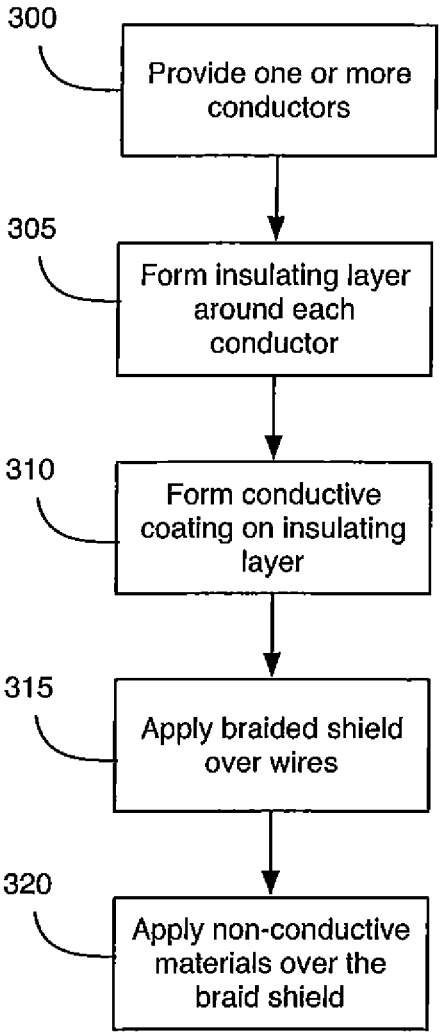
FIG. 3 illustrates a group of operations for forming the cable of FIG. 2A.

FIG. 3 illustrates a group of operations for forming a cable that may correspond to the cable 16, described above. At block 300, a group of conductors is provided. The conductors may be copper or a different conductive material. The conductor may have a solid core or may be stranded. A gauge of the conductor may be 52 AWG-36 AWG.

At block 305, an insulating layer is formed around each conductor. The insulating layer may be a material, such as polyethylene, a fluorocarbon polymer, or polyvinyl chloride. The diameter of the insulating layer may be about 0.025 to 0.64 mm (0.001 to 0.025 inch).

At block 310, a conductive coating is formed on an outer surface of the insulating layer. The conductive coating may, for example, be applied via a spraying or dispersion process. The coating may be a material such as carbon, graphite, graphene, silver, or copper, and may be in a suspended solution. Other conductive materials capable of application on the insulating layer via spraying or dispersion may be utilized. The thickness of the conductive coating may be about 0.005 mm (0.0002 inch).

At block 315, a braided shield wire may be applied over the group of wires. The braided shield wire may be silver-plated copper and may be formed as a mesh configured to surround the wires.

At block 320, a sheath may be applied around the braided shield wire. The sheath may be a material such as polyvinyl chloride, polyurethane, or a fluorocarbon polymer. The outside diameter of the sheath of about 0.635 to 12.7 mm (0.025 to 0.500 inch) may accommodate 10 to 500 wires within the sheath. One embodiment has a cable with an outer diameter of about 12.7 mm (0.5 inch) and the number of wires of the plurality of wires is about 500.

Other operations may be provided to further enhance the characteristics of the cable and/or to provide additional beneficial features. For example, in some implementations, one or more non-insulated wires are positioned among the wires before the braided shield is applied over the wires. As described above, the non-insulated wires may be terminated to ground at an end of the cable. The conductive coating of the insulated wires is subsequently grounded by virtue of the contact that exists within the cable between the non-insulated wires and the conductively coated insulated wires.

In some implementations, first and/or second respective ends of the plurality of wires are attached in a side-by-side manner to form one or more groups of ribbons. Wires within the groups may be selected based on a predetermined relationship between signals propagated over the wires.

While various embodiments of the embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A cable assembly comprising:

a plurality of wires, each having a first end, a second end, and an intermediate section, the intermediate sections of respective wires of the plurality of wires being detached from each other; and a conductive shield surrounding the respective intermediate sections of the plurality of wires;

wherein each wire of the plurality of wires includes:

a conductor;

an insulating layer that surrounds the conductor; and a conductive coating applied on an outside surface of the insulating layer, said conductive coating being graphene; and wherein said conductive coating lowers the mutual capacitance between adjacent insulated wires and cross-talk measured between the plurality of wires is less than −34 dB below 5 MHz.

2. The cable assembly according to claim 1, wherein a thickness of the conductive coating is less than 0.005 mm (0.0002 inch).

3. The cable assembly according to claim 1, further comprising at least one non-insulated wire positioned within an interior space defined by the conductive shield.

4. The cable assembly according to claim 1, wherein the first and second ends of the plurality of wires are attached in a side-by-side manner to form a ribbon.

5. The cable assembly according to claim 1, wherein a thickness of the insulating layer surrounding the conductor is about 0.025 to 0.64 mm (0.001 to 0.025 inch).

6. The cable assembly according to claim 1, wherein the wire includes a conductor having a gauge of 36 AWG to 52 AWG.

7. The cable assembly according to claim 6, wherein the conductor is selected from the group of conductors consisting of: copper, silver-plated copper, tin-plated copper, and gold-plated copper.

8. The cable assembly according to claim 1, wherein a mutual capacitance between any two of the plurality of wires is less than 2pF when a length of the plurality of wires is about 0.91 meter (3 feet) long.

9. The cable assembly according to claim 1, wherein an outer diameter of the cable is about 12.7 mm (0.500 inch) and a number of wires of the plurality of wires is about 500.

10. A method for manufacturing a cable assembly comprising:

providing a plurality of conductors;

forming an insulating layer around each conductor of the plurality of conductors to thereby form separate insulated wires;

forming a conductive coating by an application process on an outside surface of the insulating layer of each wire, said conductive coating being graphene;

applying a braided shield over the plurality of wires; and applying a sheath over the braided shield:

wherein cross-talk measured between the plurality of wires is less than −34 dB below 5 MHz.

11. The method according to claim 10, wherein a thickness of the conductive coating is less than 0.010 mm.

12. The method according to claim 10, further comprising providing at least one non-insulated wire within an interior space defined by the conductive shield.

13. The method according to claim 10, wherein first and second respective ends of the plurality of wires are attached in a side-by-side manner to form a ribbon.

14. The method according to claim 10, wherein a thickness of the insulating layer surrounding the conductor is about 0.05 mm (0.002 inch).

15. The method according to claim 10, wherein the conductor within the wire is a conductor having a gauge of 36 AWG to 52 AWG.

16. The method according to claim 10, wherein a mutual capacitance between any two of the plurality of wires is less than 2pF when a length of the plurality of wires is about 0.91 meter (3 feet) long.

17. The method according to claim 10, wherein an outer diameter of the cable is about 12.7 mm (0.5 inch) and a number of wires of the plurality of wires is about 500.

* * * * *